US007195518B2

(12) United States Patent
Bert et al.

(10) Patent No.: US 7,195,518 B2
(45) Date of Patent: Mar. 27, 2007

(54) ELECTRICAL CONNECTOR WITH ENHANCED JACK INTERFACE

(75) Inventors: Linda Ellen Bert, Camp Hill, PA (US); Sam Denovich, Harrisburg, PA (US); James Joseph Eberle, Jr., Hummelstown, PA (US); Ralph Sykes Martin, Mount Airy, NC (US); Michael Patrick Green, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/119,858

(22) Filed: May 2, 2005

(65) Prior Publication Data

US 2006/0246780 A1 Nov. 2, 2006

(51) Int. Cl.
*H01R 13/648* (2006.01)

(52) U.S. Cl. ..... 439/608; 439/290

(58) Field of Classification Search ..... 439/608, 439/610, 290, 392

See application file for complete search history.

(56) References Cited

U.S. PATENT DOCUMENTS 5,013,262 A * 5/1991 Shibano ..... 439/610
5,895,292 A 4/1999 Affeltranger ..... 439/610
6,056,586 A * 5/2000 Lin ..... 439/460
6,077,122 A * 6/2000 Elkhatib et al. ..... 439/608
6,080,018 A * 6/2000 Ferrill et al. ..... 439/610
6,129,586 A * 10/2000 Bellemon ..... 439/607
6,494,743 B1 * 12/2002 Lamatsch et al. ..... 439/608
6,629,858 B2 10/2003 Lo et al.
6,702,617 B1 * 3/2004 Clement et al. ..... 439/608
6,716,054 B1 4/2004 Denovich et al.
6,758,695 B2 7/2004 Pepe et al.
6,780,054 B2 8/2004 Yip et al.

OTHER PUBLICATIONS

NewLine MMC3000 Catalogue 2003, BKS Plug in High-Tech! pp. 1-7; pp. 16-22.

* cited by examiner

*Primary Examiner*—Hae Moon Hyeon

(57) ABSTRACT

A connector includes a housing having a mating end, a wire receiving end, and a longitudinal axis therethrough. The housing holds a plurality of contacts grouped in differential pairs and arranged about the axis. At least one shielding member is located within the housing. The shielding member isolates each differential contact pair from an adjacent differential contact pair. An organizer is configured for attachment to the wire receiving end of the housing. The organizer defines a central opening that receives a plurality of signal wires carrying differential signals. The organizer includes a plurality of wire guides arranged about and extending radially outward from the central opening. The wire guides receive the signal wires.

21 Claims, 8 Drawing Sheets

ELECTRICAL CONNECTOR WITH ENHANCED JACK INTERFACE

BACKGROUND OF THE INVENTION

The invention relates generally to electrical connectors, and more particularly, to a connector that minimizes crosstalk among signal conductors in the connector, minimizes return loss in a pair of signal conductors in the connector, and minimizes alien cross talk from signal conductors in neighboring connectors.

In electrical systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. The transferred signals produce crosstalk in the second path that degrades the signal routed over the second path.

For example, a typical industry standard type RJ-45 communication connector includes four pairs of conductors defining different signal paths. The RJ-45 plug design is dictated by industry standards and is inherently susceptible to crosstalk. In conventional RJ-45 plug and jack connectors, all four pairs of conductors extend closely parallel to one another over a length of the connector body. One pair of conductors is also split around another conductor pair. Thus, signal crosstalk may be induced between and among different pairs of connector conductors. The amplitude of the crosstalk, or the degree of signal degradation, generally increases as the frequency increases. More crosstalk can be created by the contacts in the jack that interface with the contacts in the plug. As signal speed and density increase, alien crosstalk, or crosstalk between neighboring connectors must also be addressed in preserving signal integrity.

At least some RJ-45 jacks include features that are intended to suppress or compensate for crosstalk. The shortcomings that are inherent in jacks such as the RJ-45 can be expected to become more serious as system demands continue to increase. It would be desirable to develop a connector that is designed to minimize both internal crosstalk and alien crosstalk at the outset rather than to correct for crosstalk after the fact.

Another source of signal degradation is return loss resulting from signal reflections along the conductors. Return loss can originate from multiple sources such as variations in impedance among the various elements in the connector as well as along the signal path. Improving return loss performance has proven to be difficult.

BRIEF DESCRIPTION OF THE INVENTION

In one aspect, an electrical connector is provided. The connector includes a housing having a mating end, a wire receiving end, and a longitudinal axis therethrough. The housing holds a plurality of contacts grouped in differential pairs and arranged about the axis. At least one shielding member is located within the housing. The shielding member isolates each differential contact pair from an adjacent differential contact pair.

Optionally, the connector includes an organizer configured for attachment to the wire receiving end of the housing. The organizer defines a central opening that receives a plurality of signal wires carrying differential signals. The organizer arranges the wires about the central opening in differential pairs. The organizer includes a plurality of wire guides arranged about the central opening and aligned with a respective contact in the housing. Each wire guide includes a wire dress slot that receives one of the signal wires. Each contact includes a wire terminating end that is received in a respective wire guide to terminate the wire to the contact when the organizer is attached to the housing. The housing further includes a plurality of webs having cavities separating each differential contact pair from an adjacent differential signal pair. The shielding members are disposed within the cavities.

In another aspect, an electrical connector includes a housing holding a plurality of contacts arranged in differential pairs. The housing has a mating end and a wire receiving end. The mating end is configured to receive a mating connector. At least one shielding member is located within the housing. The shielding members isolate each differential contact pair from an adjacent differential contact pair. The shielding members are positioned within the housing such that the shielding members electrically engage corresponding shielding members in the mating connector.

In a further aspect, an electrical connector is provided that includes a housing holding a plurality of contacts, symmetrically arranged in differential pairs about a longitudinal axis. The housing has a mating end and a wire receiving end. An organizer is configured for attachment to the wire receiving end of the housing. The organizer defines a central opening that receives a plurality of signal wires carrying differential signals. The organizer arranges the wires in a pattern to enhance transmission performance in the differential pairs.

In yet another aspect, an electrical connector assembly is provided that includes a first connector including a first housing having a first mating end, a wire receiving end, and a longitudinal axis therethrough. The first housing holds a plurality of contacts grouped in differential pairs and arranged in a first connector contact pattern about the axis. At least one shielding member is located within the first housing. The shielding member isolates each differential contact pair from an adjacent differential contact pair. The assembly also includes an adapter that has a second housing having a second mating end and an interface end. The second mating end is received in the first mating end of the first housing. A plurality of interface contacts at the interface end are arranged in a first contact pattern, and a plurality of mating contacts at the second mating end are arranged in a second contact pattern. The second contact pattern is different from the first contact pattern and complementary to the first connector contact pattern. The first and second contact patterns enable a second connector having contacts in a pattern complementary to the first contact pattern to be electrically connected to the first connector.

DETAILED DESCRIPTION OF THE INVENTION

Figure 1:
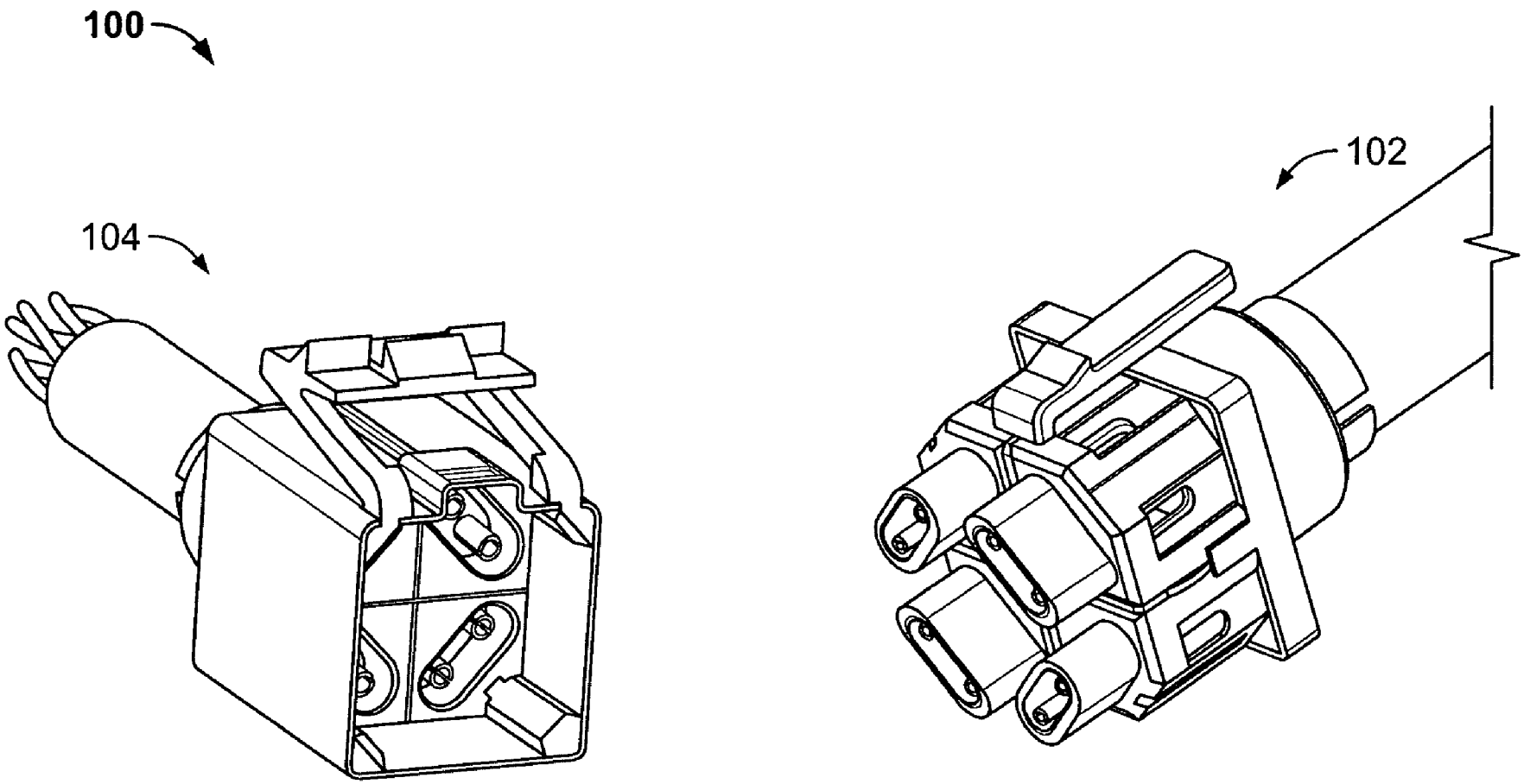
FIG. 1 is a perspective, view of a connector assembly formed in accordance with an exemplary embodiment of the present invention.

FIG. 1 is a perspective view of a connector assembly 100 formed in accordance with an exemplary embodiment of the present invention. The assembly includes a plug 102 and a jack 104 that are configured to mate with one another. The jack 104 may be mounted on a wall or panel, or, alternatively, may be mounted in an electrical device or apparatus having a communications port through which the device may communicate with other external networked devices. The assembly 100 will be described in terms of an assembly carrying four differential signal pairs. However, it is to be understood that the benefits described herein are also applicable to other connectors carrying fewer or greater numbers of signal pairs in alternative embodiments. The following description is therefore provided for illustrative purposes only and is but one potential application of the inventive concepts herein.

Figure 2:
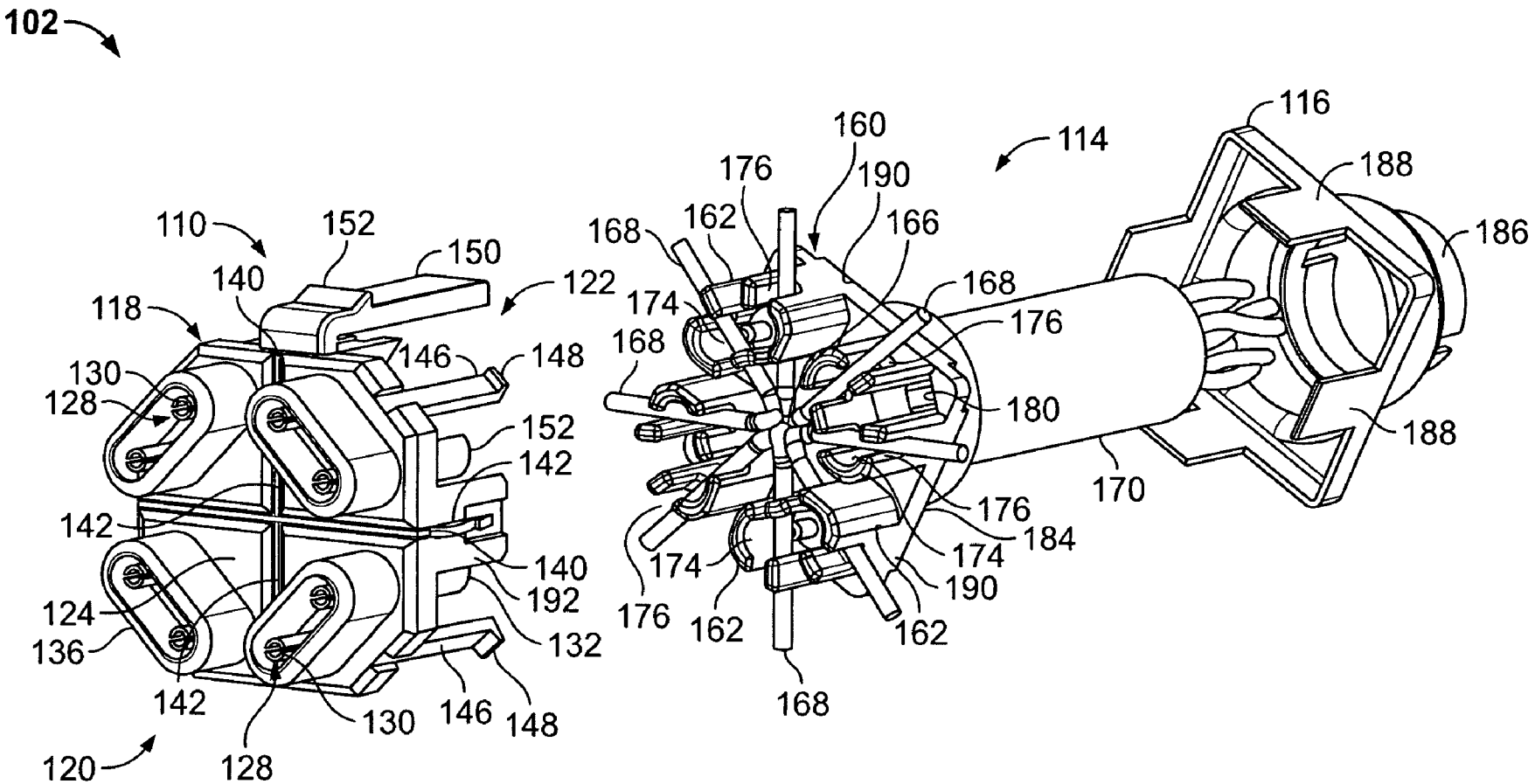
FIG. 2 is an exploded view of the plug connector shown in FIG. 1.

FIG. 2 illustrates an exploded view of the plug 102. The plug 102 includes a housing 110, an organizer 114, and a cap 116. The housing 110 has a body 118 that has a mating end 120 and a wire receiving end 122. The body 118 is fabricated from a dielectric material and includes a base 124 that holds a plurality of electrical contacts 128. Each contact 128 extends through the base 124 and has a mating end 130 proximate the mating end 120 of the body 118 and a wire terminating end 132 proximate the wire receiving end 122 of the body 118. The contacts 128 are arranged in differential pairs with the mating ends 130 of each differential pair surrounded by a shroud 136.

The connector assembly 100 is designed to have a characteristic impedance through the connector assembly 100. Impedance, or more specifically, variations in impedance along a signal path through the connector assembly 100, is a factor in the return loss of a connector assembly 100. The impedance of the connector assembly 100, and thus the return loss therein, is determined by factors such as the dielectric properties of the housing material, and particularly the material between contacts of a signal pair, the spacing between the contacts of a differential pair, the geometry of the contacts, e.g., diameter or cross section, and shield proximity, among others. Known dielectric materials include foamed polyethylene, natural polyethylene, natural polypropylene, foamed flouropolymers, natural flouropolymers, natural rubber, ceramics, glass, FR-4 printed circuit board material, and air, as well as others. In an exemplary embodiment, the connector assembly 100 has a characteristic impedance of 100 ohms and includes a mixture of natural polyethylene and air in the dielectric material, a spacing of 0.135 inches between contacts of a signal pair, 0.07 inch nominal contact diameter, and a 0.145 inch nominal distance from the signal contact pair to the shield. As known to one skilled in the art, other combinations of the different factors may also meet the requirements. In other embodiments, different impedance values may be employed. Known simulation software may be used to optimize design variables for particular design goals.

A pair of intersecting slots 140 are formed in and extend across the base 124. In the illustrated embodiment, the slots 140 divide the body into four sections, each of which holds a pair of contacts 128 that are a differential signal pair. Shielding members 142 are provided in the slots 140 to isolate the differential contact pairs from one another thereby reducing crosstalk between the differential pairs. The shielding members 142 are fabricated from a conductive material such as metal or metallized plastic, or the like. In an exemplary embodiment, the shielding members 142 are metal plates. Latch arms 146, only two of which are visible in FIG. 2, extend from the body 118 rearwardly toward the wire receiving end 122 of the body 118. A latch element 148 is formed at the end of each latch arm 146. The latch arms 146 are provided to lock the housing 110 and organizer 114 together. A connector latch lever 150 is provided that includes a latch member 152 for latching the plug 102 to the jack 104 as will be described.

The organizer 114 includes a backing plate 160 and a plurality of wire guides 162 extending therefrom. In one embodiment, the wire guides 162 are formed integrally with the backing plate 160. The wire guides 162 are arranged in pairs and are distributed about a central opening 166 in the backing plate 160. The central opening 166 receives signal wires 168 for termination with the wire terminating ends 132 of the contacts 128. The signal wires are carried in a cable 170. Each wire guide 162 includes a hole 174 that is centrally positioned and extends downwardly toward the backing plate 160. A wire dress slot 176 extends across each hole 174. The wire dress slots 176 extend to a depth that is less than the depth of the holes 174. Each wire dress slot 176 receives one of the signal wires 168. Each pair of wires 168 are twisted at a certain rate within the cable 170. The organizer 114 is designed to minimize untwisting of the signal wires 168 so as to minimize the introduction of any undesired electrical properties in the connector 102.

The wire guides 162 organize and arrange the signal wires 168 radially about the central opening 166 in preparation for termination with the contacts 128. In an exemplary embodiment, the contacts 128 are symmetrically arranged within the housing about a longitudinal axis A (FIG. 3) which is an axis of symmetry of the housing 110. For example, in one embodiment, the contacts 128 are circumferentially arranged about the axis A; however, as known to one skilled in the art, the contacts 128 may be used in any number of arrangements. The central opening 166 in the backing plate has a center (not shown) that is located substantially in line with the axis A of the housing 110 such that each of the wire guides 162 is positioned to align with one of the contacts 128. With the organizer 114, the signal wires 168 are arranged in a radial pattern wherein the differential signal pairs are grouped together and spaced apart or separated. The spacing is chosen to enhance return loss performance. The signal wires 168 are also laid out to be substantially equal in length when terminated within the housing 110 so as to equalize signal paths within the plug 102 to prevent skew in the plug 102. The signal wires 168 are terminated to the contacts 128 when the organizer 114 is attached to the housing 110.

The backing plate 160 includes openings 180 that receive the latch elements 148 from the latch arms 146. In the embodiment shown in FIG. 2, the backing plate 160 is substantially square and includes an opening 180 proximate each corner. Only one of the openings 180 is visible in FIG. 2. When the housing 110 and the organizer 114 are joined, the wire terminating ends 132 of the contacts 128 are received in the holes 174 of the wire guides 162 and the latch elements 148 are received through the openings 180 and latch against a rearward side 184 of the backing plate 160 with snap-fit engagement to lock the housing 110 and the organizer 114 together. The cap 116 includes a collar 186 that receives the cable 170. Tabs 188 on the cap 116 frictionally engage side edges 190 of the backing plate 160 and sides 192 of the body 118 to secure the cable 170 to the organizer 114. The cap 116 is fabricated from a metal or metallized material. The tabs 188 also engage the edges of the shielding members 142 to electrically connect to the shielding members 142. The cable 170 includes a cable shield (not shown) which is folded back over the cable when the cable is inserted into the organizer. A crimp connection is formed at the collar 186 to provide electrical connection between the cable shield and the cap 116. The cap 116 also provides shielding for the rear of the plug 102 to reduce alien crosstalk between the connector and other electrical devices. The cap 116 also electrically connects the plug shield members 142 to the jack shield 214 (FIG. 4) when the jack 104 (FIG. 1) and plug 102 are mated.

Figure 3:
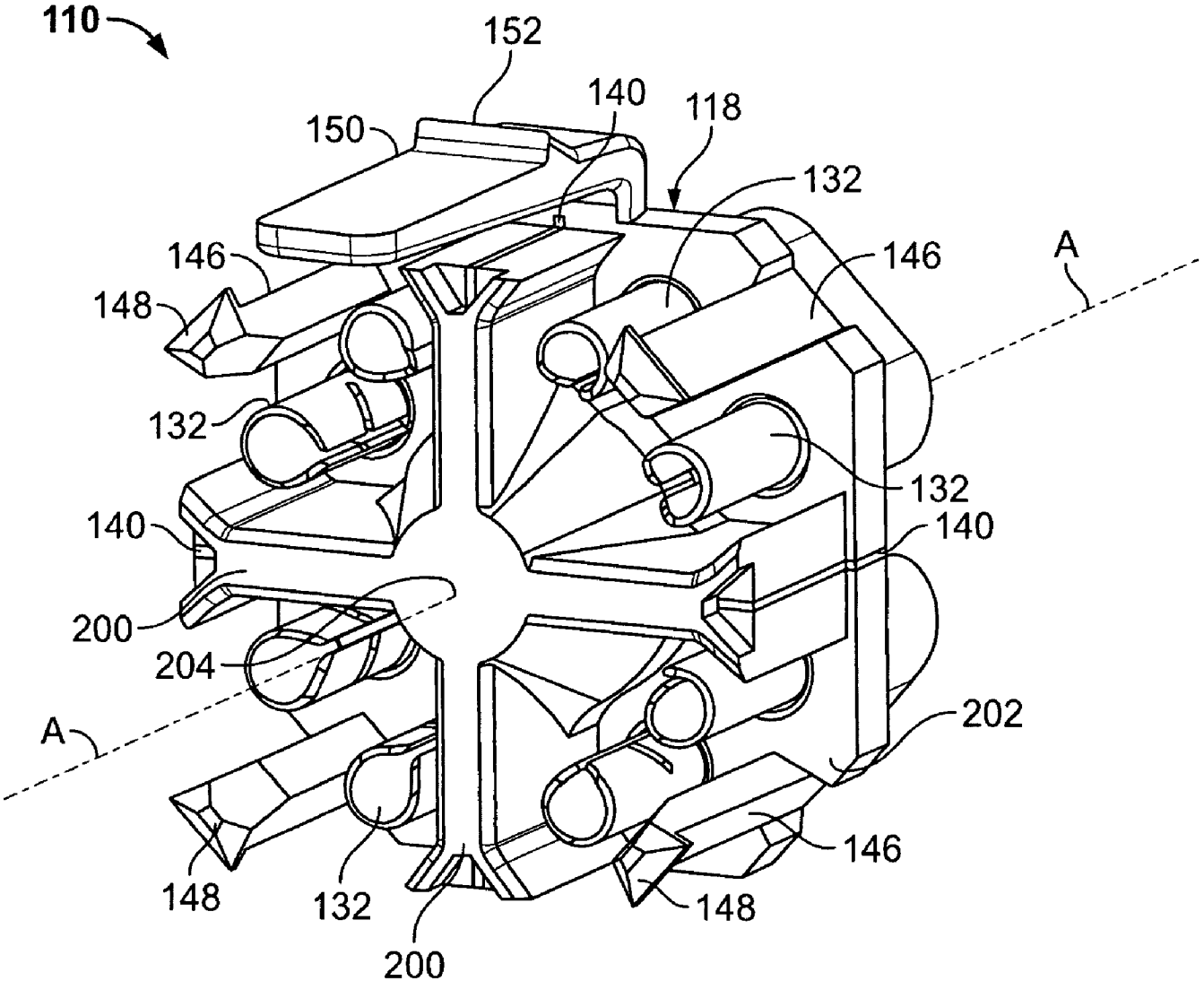
FIG. 3 is a rear perspective view of the plug housing shown in FIG. 2.

FIG. 3 illustrates a rear perspective view of the plug housing 110. Intersecting webs 200 extend rearwardly from a back side 202 of the base 124. The slots 140 extend through the base 124 and into the webs 200. The slots 140 do not extend completely through the webs 200 so that the shield plates 142 (FIG. 2) are retained in the webs 200. The housing 110 has a longitudinal axis A that is an axis of symmetry through a center 204 of the housing 110 (without the latch lever 150). The terminating ends 132 of the contacts 128 are arranged around the axis A and the webs 200 separate differential contact pairs from one another. In an exemplary embodiment, the terminating ends 132 of the contacts 128 are arranged circumferentially around the axis A. Moreover, when shielding members 142 (FIG. 2) are placed in the slots 140, the differential contact pairs are shielded from one another to reduce or eliminate crosstalk between the differential contact pairs.

Figure 4:
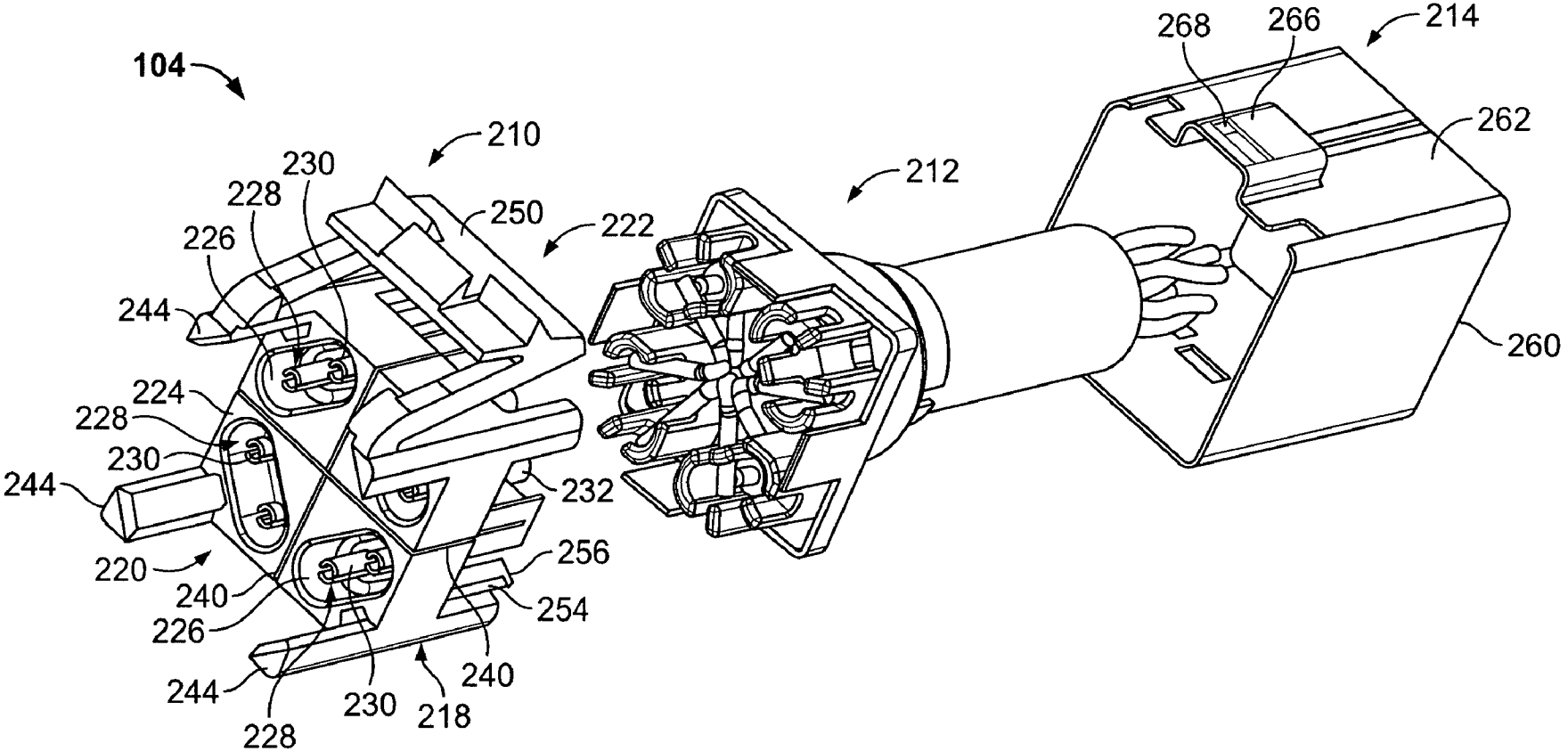
FIG. 4 is an exploded view of the jack connector shown in FIG. 1.

FIG. 4 illustrates an exploded view of the jack 104. The jack 104 includes a housing 210, an organizer 212, and an exterior shield 214. The housing 210 has a body 218 that has a mating end 220 and a wire receiving end 222. The body 218 is fabricated from one or more dielectric materials and includes a base 224 that includes a plurality of contact wells 226, each of which holds a pair of electrical contacts 228. Each contact 228 extends through the base 224 and has a mating end 230 proximate the mating end 220 of the body 218 and a wire terminating end 232 proximate the wire receiving end 222 of the body 218. The contacts 228 are arranged in differential pairs. The wells 226 are complementary in shape to the shrouds 136 on the plug housing 110 (FIG. 2) and are configured to receive the shrouds 136 when the plug 102 and jack 104 are mated with one another. A pair of intersecting slots 240 are formed in and extend across the base 224. In the illustrated embodiment, the slots 240 divide the body into four sections, each of which holds a pair of contacts 228 that are a differential pair. Shielding members (not shown) are provided in the slots 240 to isolate the differential contact pairs from one another thereby reducing crosstalk between the differential pairs. The shielding members are fabricated from a conductive material such as metal or metallized plastic, or the like.

The housing body 218 includes posts 244 that forwardly extend from the base 224. The posts 244 act as guides that receive the plug 102 to align the plug 102 (FIG. 1) for mating with the jack 104. A mounting latch 250 is pivotably joined to forward ends of two adjacent posts 244. The mounting latch 250 is provided to facilitate mounting the jack 104 in a panel, faceplate, chassis, or electrical box and the like. The body 218 also includes a plurality of latch arms 254 that rearwardly extend from the body 218 toward the wire receiving end 222 of the body 218. A latch element 256 is formed at the end of each latch arm 254. The latch arms 254 are provided to lock the housing 210 and organizer 212 together. Only one latch arm 254 is visible in FIG. 4. However, four latch arms, and their corresponding latch elements 256, are visible in FIG. 5. The organizer 212 is identical to the organizer 114 and will not be separately described.

The exterior shield 214 is provided to enclose the assembled housing 210 and organizer 212 as shown in FIG. 1. The external shield 214 isolates the plug 102 (FIG. 1) and jack 104, when mated, from noise from neighboring connectors (not shown), cables, or other external sources. The exterior shield provides an electrical path, such as a ground path for the shielding within the plug 102 and jack 104. The external shield 214 cooperates with the internal shielding provided by the shielding members in the plug 102 and jack 104 to minimize signal degradation due to alien crosstalk and other external sources of noise. In an exemplary embodiment, the external shield is fabricated from a conductive metal material. Other materials such as metallized plastic may be used in other embodiments. Furthermore, as described previously, in some embodiments, shielded cable is also employed.

The external shield 214 includes a hollow body 260 that is generally box shaped. The body 260 has an upper surface 262 that is aligned with the mounting latch 250 on the jack housing 210 to orient the jack housing 210 in the external shield 214. The upper surface 262 includes a raised channel 266 that is configured to receive the latch lever 150 on the plug housing 110 (FIG. 2). In this manner, the plug 102 (FIG. 1) is aligned with the jack 104 when the plug 102 and jack 104 are mated. The channel 266 includes an opening 268 that receives the latch member 152 on the latch lever 150 to inhibit separation of the plug 102 from the jack 104 once mated. When it is desired to unmate the plug 102 and jack 104, the latch lever 150 is depressed to release the latch member 152 from the opening 268 after which withdrawal of the latch lever 150 from the channel 266 is permitted as well as separation of the plug 102 from the jack 104.

Figure 5:
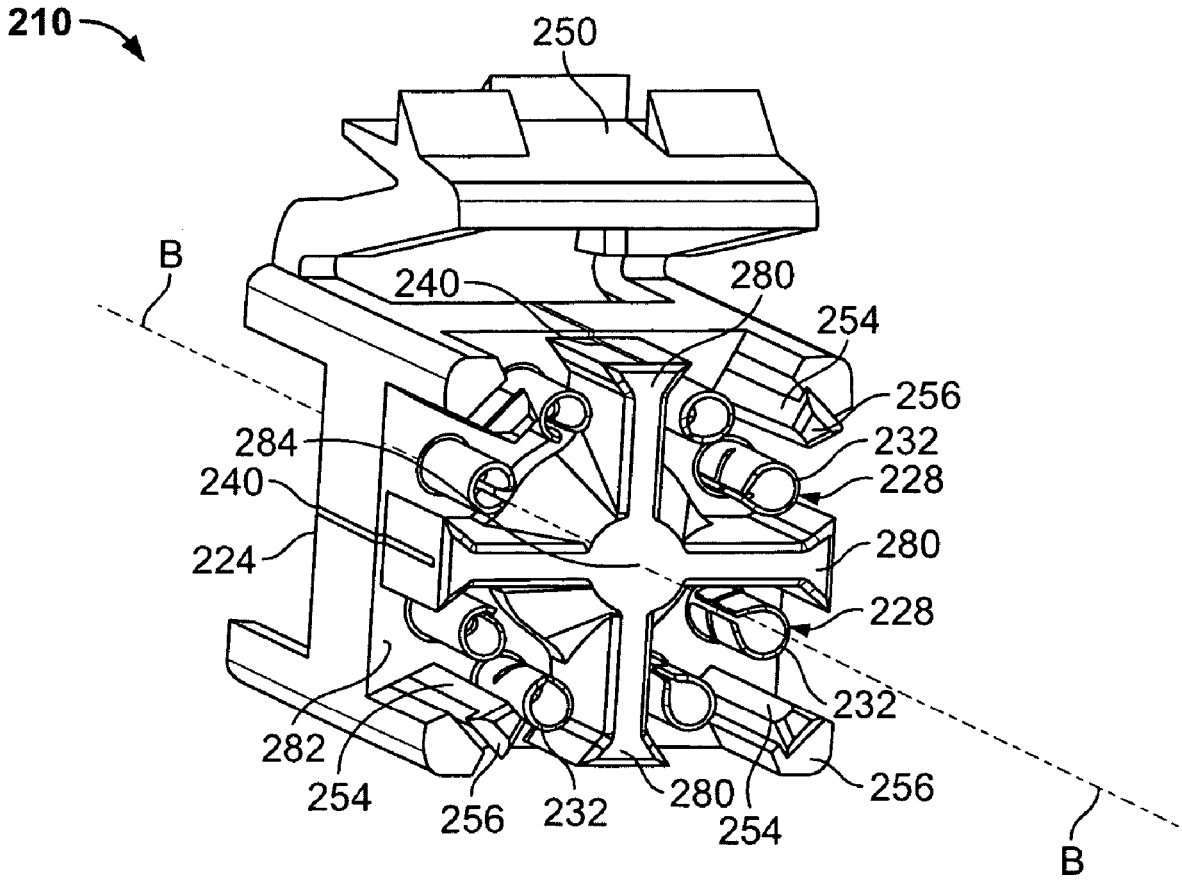
FIG. 5 is a rear perspective view of the jack housing shown in FIG. 4.

FIG. 5 illustrates a rear perspective view of the jack housing 210. Intersecting webs 280 extend rearwardly from a back side 282 of the base 224. The slots 240 are formed in the webs 280. The slots 240 do not extend completely through the webs 280 so that the shield plates are retained in the webs 280. The housing 210 has a longitudinal axis B that, without regard to the mounting latch 250, is an axis of symmetry through a center 284 of the housing 210. The contacts 228 are arranged around the axis B and the webs 280 separate differential contact pairs from one another. In an exemplary embodiment, the terminating ends 132 of the contacts 228 are arranged circumferentially around the axis B. In other embodiments, however, other arrangements of the terminating ends 132 may be employed. Moreover, when shielding members (not shown) are placed in the slots 240, the differential contact pairs are shielded from one another to reduce or eliminate crosstalk between the differential contact pairs.

Figure 6:
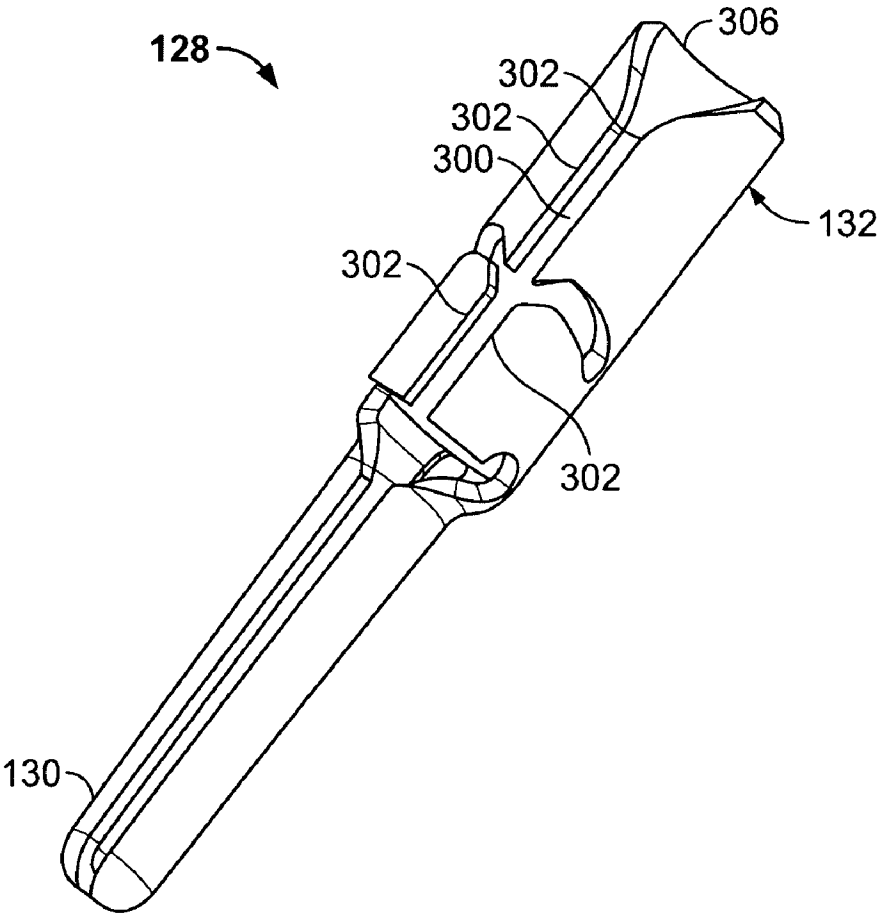
FIG. 6 is a perspective view of a pin contact formed in accordance with an exemplary embodiment of the present invention.

FIG. 6 illustrates a perspective view of a contact 128 used in the plug 102 (FIG. 2). The mating end 130 of the contact 128 is a pin contact. The opposite wire terminating end 132 is a barrel type insulation displacement contact (IDC). The wire terminating end 132 includes a wire receiving slot 300 that is formed between insulation cutting edges 302. A wire cutting edge 306 is formed at an open end of the wire terminating end 132. When the organizer 114 is joined with the plug housing 110, the wire terminating ends 132 of the contacts 128 are received in the holes 174 (FIG. 2) in the wire guides 162. The insulation cutting edges 302 cut through the insulation on the signal wires 168 (FIG. 2) terminating the wires to the contacts 128 to establish electrical connections therewith. Simultaneously, the wire cutting edges 306 cut off the excess length of the signal wires 168.

Figure 7:
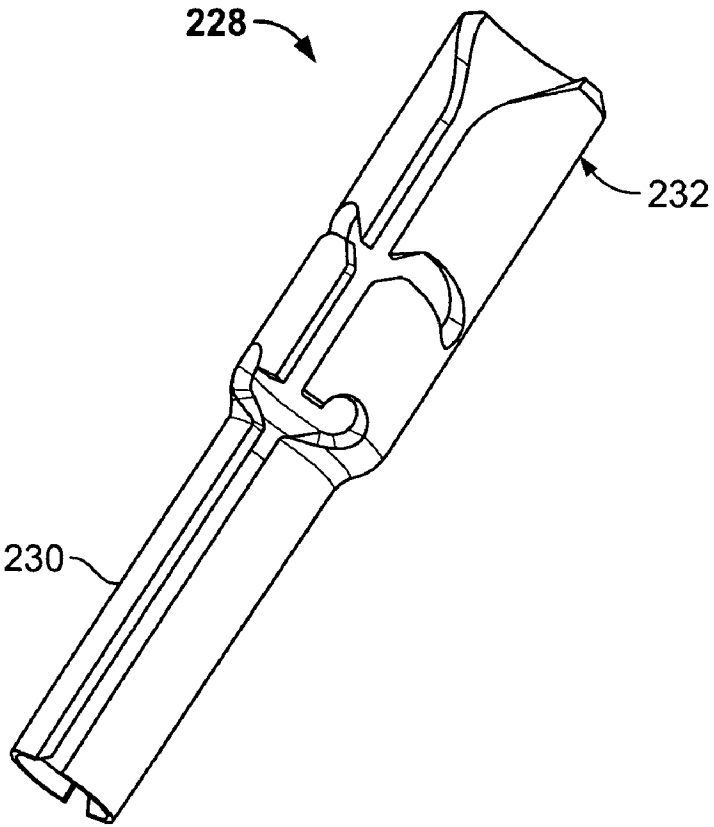
FIG. 7 is a perspective view of a socket contact formed in accordance with an exemplary embodiment of the present invention.

FIG. 7 illustrates a perspective view of a contact 228 used in the jack 104 (FIG. 4). The mating end 230 of the contact 228 is a socket contact that is configured to receive the pin portion or mating end 130 of the plug contact 128. In other respects, the contact 228 is identical to the contact 128 described above with the same wire terminating features. The pin and socket connection between the plug 102 (FIG. 2) and jack 104 provides a more reliable connection than, for instance, a known blade and spring connection found in standard RJ-45 connectors.

Figure 8:
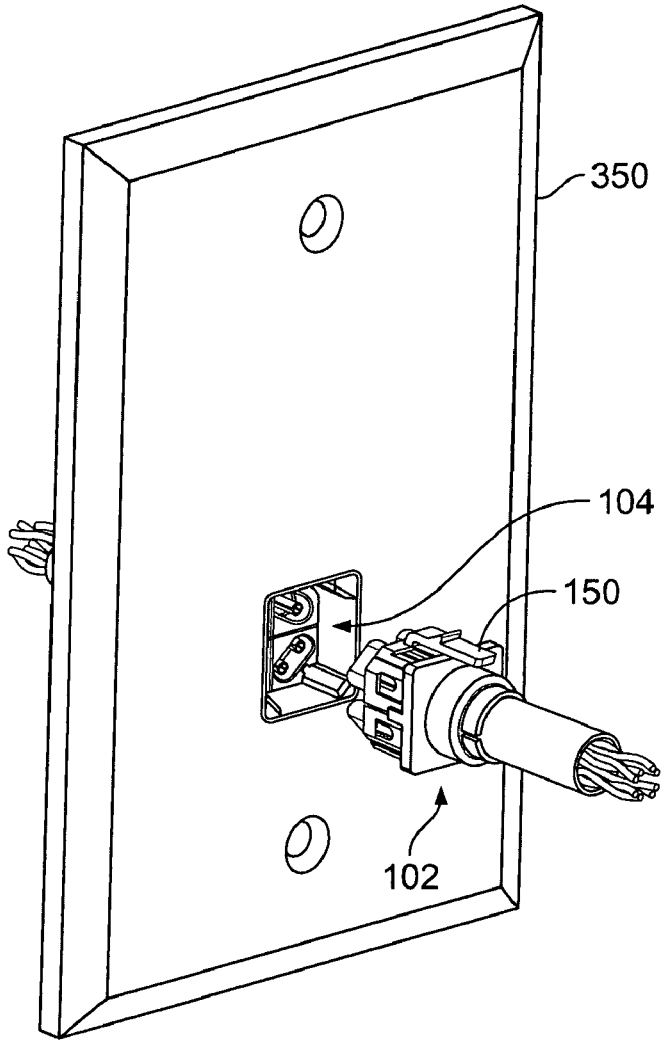
FIG. 8 is a perspective view of the connector assembly shown in FIG. 1 used in a wall mount installation.

FIG. 8 illustrates a wall mount installation of the connector assembly 100. In FIG. 8, the jack 104 is mounted in a wall (not shown) as is common for telecommunications connections. Access to the jack 104 is made available through a face plate 350. Mating and unmating of the plug 102 and jack 104 is as previously described through the operation of the latch lever 150.

Figure 9:
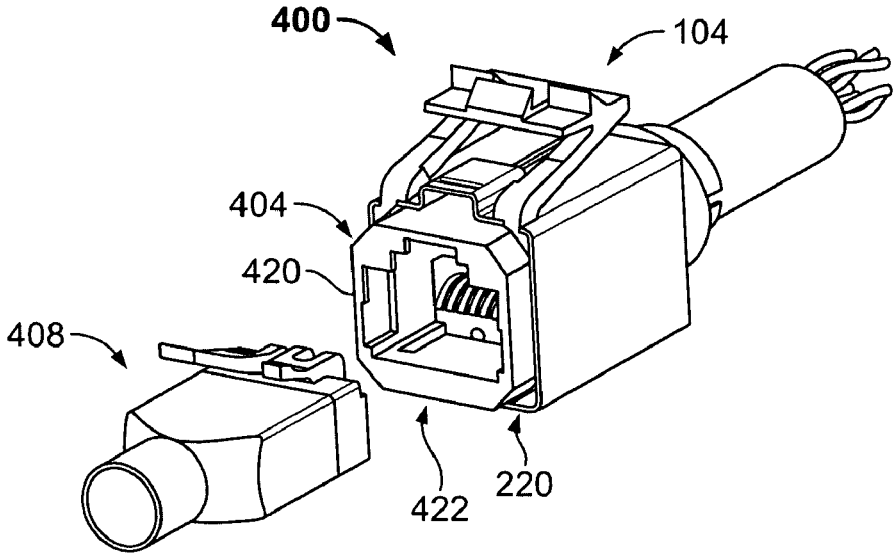
FIG. 9 is a perspective view of a connector assembly including an interface adapter formed in accordance with an exemplary embodiment of the present invention.

FIG. 9 illustrates a perspective view a connector assembly 400 that includes a jack 104, an adapter 404, and a plug connector 408. The adapter 404 provides an interface that allows a plug, other than the plug 102 to be mated with the jack 104. In an exemplary embodiment, the plug connector 408 is a standard RJ-45 plug. In other embodiments, the adapter 404 may be configured to accept other plug connectors having configurations different from an RJ-45. The adapter 404 is received in the mating end 220 of the jack 104. The adapter 404 includes a housing 420 that itself includes an interface end 422 that receives the plug connector 408.

Figure 10:
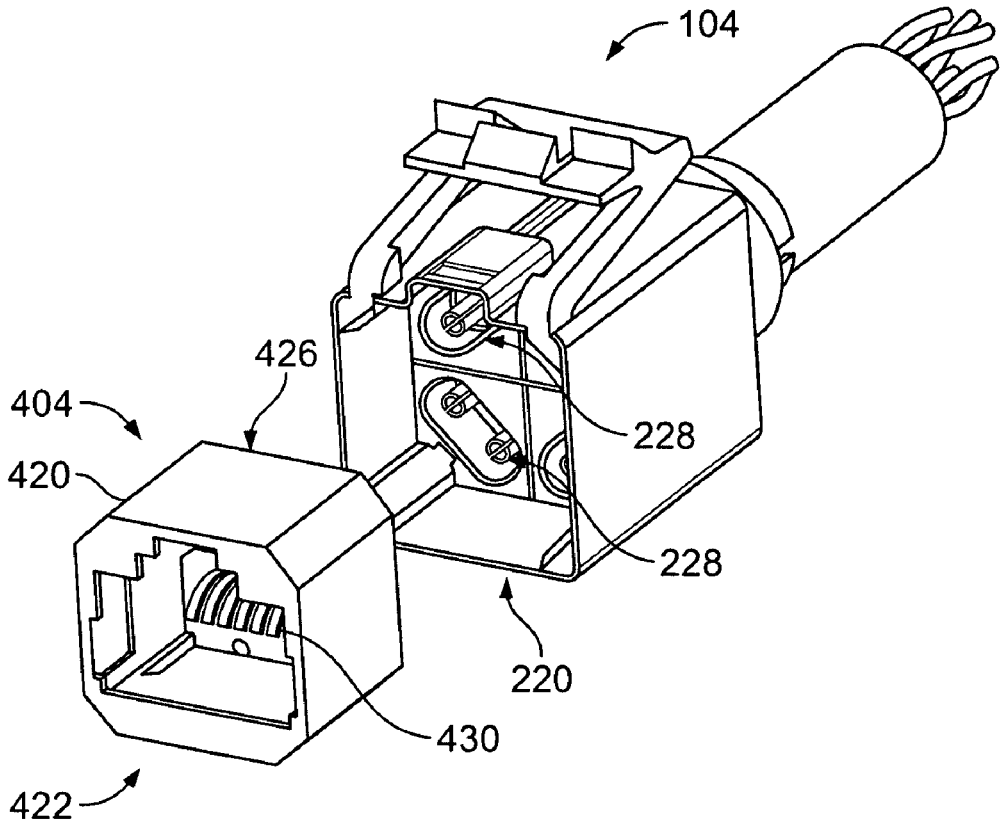
FIG. 10 is a front exploded view of the adapter and jack shown in FIG. 9.

FIG. 10 is a front exploded view showing the adapter 404 separated from the jack 104. The housing 420 of the adapter 404 includes a mating end 426 opposite the interface end 422. The mating end 426 is received in the mating end 220 of the jack 104. The adapter 404 includes contacts 430 that are complementary to contacts (not shown) in the plug connector 108 (FIG. 9). In an exemplary embodiment, the contacts 430 are spring contacts that are configured to mate with an RJ-45 plug.

Figure 11:
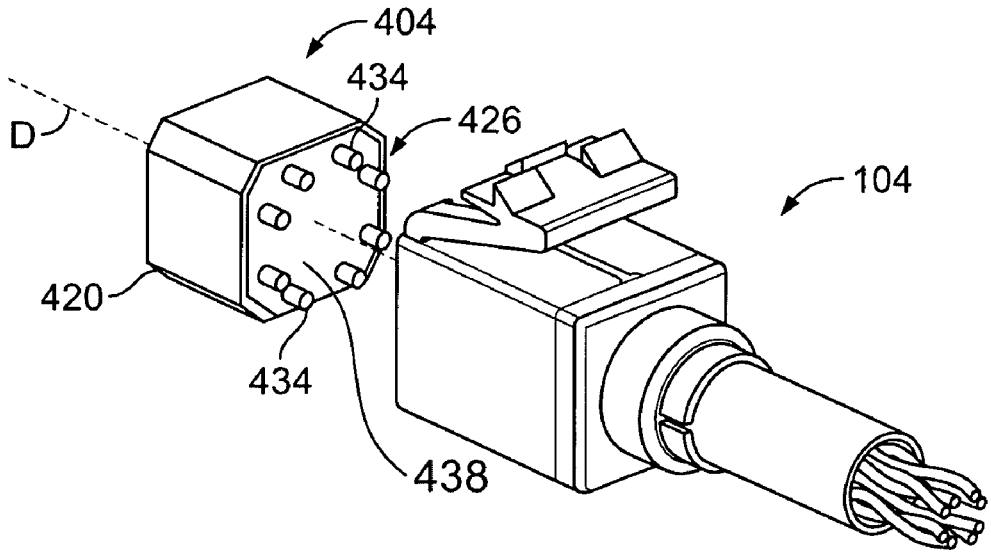
FIG. 11 is a rear exploded view of the adapter and jack shown in FIG. 10.

FIG. 11 is a rear exploded view of the adapter 404 separated from the jack 104. Terminal contacts 434 extend from a rear wall 438 at the mating end 426 and are configured to mate with the contacts 228 (FIG. 10) in the jack 104. In an exemplary embodiment, the rear wall 438 may be a printed circuit board. The contacts 430 (FIG. 10) at the interface end 422 of the adapter 404 are electrically connected to the terminal contacts 434 within the adapter 404. The contacts 430 and the terminal contacts 434 may be unitarily formed or may be separately formed and electrically connected to each other through electrical traces in a printed circuit board or by other known methods. Moreover, the adapter 404 may include active components such as power devices, processors, capacitive devices, inductive devices, LED's, and the like that may alter the electrical signal.

The terminal contacts 434 are positioned in an arrangement or pattern that is complementary to the contact pattern in the jack 104 thereby enabling the plug connector 408 (FIG. 9) to be interfaced with the jack 104. The arrangement of the terminal contacts may correspond or may differ from the arrangement of the contacts 430 at the interface end 422 of the adapter housing 420. In one embodiment, the terminal contacts are arranged about a centerline D through the adapter 404. Multiple embodiments of the adapter 404 are contemplated that include different patterns between contacts, such as the contacts 430 at the interface end 422 of the adapter 404, and terminal contacts 434 at the mating end 426 of the adapter 404 that are complementary with the contact patterns of different plug connectors. Furthermore, while the adapter has been described as having an interface end and a mating end, or rather, an interface on each side, in alternative embodiments, the adapter may have an interface on one side and an end device, such as a display, a wireless access point, or a sensor, and the like at the other side.

The embodiments thus described provide an enhanced connector assembly 100 including a plug 102 and mating jack 104 for transmitting differential signals with a minimum of noise such as cross talk and with a minimum of signal degradation. The plug 102 and jack 104 each includes an organizer that separates differential pairs from one another and provides internal and external shielding to reduce crosstalk. The plug 102 and jack 104 are symmetrical with respect to the lengths of the signal paths through the connector assembly 100. The connector assembly provides enhanced transmission performance including enhanced return loss performance, reduced crosstalk, reduced alien crosstalk, and reduced skew.

While the invention has been described in terms of various specific embodiments, those skilled in the art will recognize that the invention can be practiced with modification within the spirit and scope of the claims.

What is claimed is:

1. An electrical connector comprising:

a housing having a mating end, a wire receiving end, and a longitudinal axis therethrough, said housing holding a plurality of contacts grouped in differential pairs and arranged about said axis;

at least one shielding member located within said housing, said at least one shielding member isolating each differential contact pair from an adjacent differential contact pair; and an organizer configured for attachment to said wire receiving end of said housing, said organizer defining a central opening that receives a plurality of signal wires carrying differential signals, said organizer including a plurality of wire guides arranged about and extending radially outward from said central opening, said wire guides receiving said signal wires.

2. The connector of claim 1, wherein each said wire guide includes a wire dress slot that receives one of the signal wires and wherein each said contact includes a wire terminating end that is received in a respective wire guide to terminate the wire to said contact when the organizer is attached to said housing.

3. The connector of claim 1, wherein each said contact comprises a mating end and a wire terminating end, wherein said wire terminating end comprises an IDC contact and said mating end comprises one of a pin contact and socket contact.

4. The connector of claim 1, wherein said housing includes latch arms including latch elements that engage said organizer such that said organizer is attached to said housing with a snap fit.

5. The connector of claim 1, wherein said housing comprises a plurality of wells, and wherein each well contains a differential contact pair, and wherein each said well is configured to receive a shroud from a mating connector.

6. The connector of claim 1, wherein said housing comprises a plurality of shrouds, each said shroud surrounding a differential contact pair, and wherein each said shroud is configured to be received in a well in a mating connector.

7. The connector of claim 1, wherein said connector further comprises an external shield that receives said housing, said external shield including a raised channel that receives a portion of a latch lever on a mating connector to orient the said connector with the mating connector.

8. The connector of claim 1, said organizer arranging the wires about said central opening in differential pairs.

9. The connector of claim 1, said organizer arranging the wires about said central opening in differential pairs, and wherein the signal wires are terminated to respective contacts when said organizer is attached to said housing.

10. An electrical connector comprising:

a housing holding a plurality of contacts arranged in differential pairs, said housing having a mating end and a wire receiving end, said mating end configured to receive a mating connector;

an organizer configured for attachment to said wire receiving end of said housing, said organizer defining a central opening that receives a plurality of signal wires carrying differential signals, said organizer including a plurality of wire guides arranged about and extending radially outward from said central opening, said wire guides receiving said signal wires; and at least one shielding member located within said housing, said at least one shielding member isolating each differential contact pair from an adjacent differential contact pair, and, and wherein said at least one shielding member is positioned within said housing such that said at least one shielding member electrically engages a corresponding shielding member in the mating connector.

11. The connector of claim 10, wherein said differential contact pairs are arranged about a longitudinal axis, said organizer arranging said signal wires radially about said central opening in differential pairs, wherein said signal wires are terminated to respective contacts when said organizer is attached to said housing.

12. The connector of claim 10, wherein each of said wire guides is aligned with a respective contact in said housing, each said wire guide including a wire dress slot that receives one of the signal wires; and wherein each said contact includes a wire terminating end that is received in a respective wire guide to terminate the wire to said contact when the organizer is attached to said housing.

13. The connector of claim 10, wherein each said contact comprises a mating end and a wire terminating end, wherein said wire terminating end comprises an IDC contact and said mating end comprises one of a pin contact and socket contact.

14. The connector of claim 10, wherein said housing includes latch arms having latch elements that engage said organizer to attach said organizer to said housing with a snap fit.

15. The connector of claim 10, wherein said housing comprises a plurality of wells, and wherein each well contains a differential contact pair, and wherein each said well is configured to receive a shroud from a mating connector.

16. The connector of claim 10, wherein said housing comprises a plurality of shrouds, each said shroud surrounding a differential contact pair, and wherein each said shroud is configured to be received in a well in a mating connector.

17. The connector of claim 10, wherein said connector further comprises an external shield that receives said housing, said external shield including a raised channel that receives a portion of a latch lever on a mating connector to orient the said connector with the mating connector.

18. The connector of claim 10, wherein said housing includes latch arms including latch elements that engage said organizer such that said organizer is attached to said housing with a snap fit.

19. An electrical connector comprising:

a housing having a mating end, a wire receiving end, and a longitudinal axis therethrough; said housing holding a plurality of contacts grouped in differential pairs and arranged about said axis; and at least one shielding member located within said housing, said at least one shielding member isolating each differential contact pair from an adjacent differential contact pair, wherein said housing further comprises a plurality of webs having shield cavities separating each differential contact pair from an adjacent differential signal pair, and wherein said at least one shielding member is disposed within said shield cavities.

20. An electrical connector comprising:

a housing holding a plurality of contacts arranged in differential pairs, said housing having a mating end and a wire receiving end, said mating end configured to receive a mating connector; and at least one shielding member located within said housing, said at least one shielding member isolating each differential contact pair from an adjacent differential contact pair, and, and wherein said at least one shielding member is positioned within said housing such that said at least one shielding member electrically engages a corresponding shielding member in the mating connector, wherein said housing further comprises a plurality of webs having shield cavities separating each differential contact pair from an adjacent differential signal pair, and wherein said at least one shielding member is disposed within said shield cavities.

21. An electrical connector comprising:

a housing holding a plurality of contacts, symmetrically arranged in differential pairs about a longitudinal axis, said housing having a mating end and a wire receiving end;

an organizer configured for attachment to said wire receiving end of said housing, said organizer defining a central opening that receives a plurality of signal wires carrying differential signals, said organizer including a plurality of wire guides arranged about and extending radially outward from said central opening, said wire guides receiving said signal wires, said wire guides directing said signal wires radially outward from said central opening organized in differential pairs; and wherein said organizer arranges the wires in a pattern to enhance transmission performance in the differential pairs.

* * * * *